US009278460B2

(12) United States Patent
Meznaric et al.

(10) Patent No.: US 9,278,460 B2
(45) Date of Patent: Mar. 8, 2016

(54) APPARATUS FOR THE CROSS-PERFORATION OR CROSS-CUTTING OF CONTINUOUS MATERIAL WEBS

(75) Inventors: Andre Meznaric, Bern (CH); Toni Egli, Hochdorf (CH)

(73) Assignee: HUNKELER AG, Wikon (CH)

( * ) Notice: Subject to any disclaimer, the term of this patent is extended or adjusted under 35 U.S.C. 154(b) by 522 days.

(21) Appl. No.: 13/067,156

(22) Filed: May 12, 2011

(65) Prior Publication Data

US 2011/0277608 A1 Nov. 17, 2011

(30) Foreign Application Priority Data

May 14, 2010 (EP) ..... 10005073

(51) Int. Cl.

| | |
|---|---|
| ***B26D 1/36*** | (2006.01) |
| ***B26D 7/26*** | (2006.01) |
| ***B26F 1/20*** | (2006.01) |
| *B26D 1/40* | (2006.01) |
| *B26D 1/62* | (2006.01) |

(52) U.S. Cl.

CPC ..... *B26D 7/2628* (2013.01); *B26D 7/2614* (2013.01); *B26F 1/20* (2013.01); *B26D 1/405* (2013.01); *B26D 1/626* (2013.01); *Y10T 83/4795* (2015.04); *Y10T 83/9399* (2015.04); *Y10T 83/9406* (2015.04); *Y10T 83/9471* (2015.04)

(58) Field of Classification Search

CPC ..... B26F 1/20; B26D 1/405; B26D 1/626; B26D 7/2614; B26D 7/2628; Y10T 83/4795; Y10T 83/4838; Y10T 83/9399; Y10T 83/9406; Y10T 83/9471; Y10T 83/949

USPC ..... 83/331, 343–348, 674, 677, 698.41, 83/698.51, 698.61, 698.31, 699.11, 83/699.31, 699.41, 699.51, 699.61

See application file for complete search history.

(56) References Cited

U.S. PATENT DOCUMENTS

| | | | | |
|---|---|---|---|---|
| 4,920,843 | A * | 5/1990 | Stromberg et al. | 83/346 |
| 5,086,683 | A * | 2/1992 | Steidinger | 83/674 |
| 5,224,408 | A * | 7/1993 | Steidinger | 83/674 |

(Continued)

FOREIGN PATENT DOCUMENTS

| | | | |
|---|---|---|---|
| DE | 39 26 640 | A1 | 2/1991 |
| DE | 20 2006 015561 | U1 | 12/2006 |
| EP | 0412383 | | 2/1991 |

OTHER PUBLICATIONS

European Search Report for Application No. EP 10 00 5073, mailed Nov. 2, 2010 (with translation).

*Primary Examiner* — Clark F Dexter

(74) *Attorney, Agent, or Firm* — Oliff PLC

(57) ABSTRACT

In a cylindrical knife holder rotatable about its longitudinal axis, at least one groove is present. The groove extends in the direction of the longitudinal axis of the knife holder. Inserted exchangeably in this groove is a perforating knife, the perforating edge of which protrudes over the peripheral surface of the knife holder. The perforating knife, which can be clamped in the groove by a releasable clamping device, is supported, at its end lying opposite the perforating edge, on a stop element disposed in the groove. The stop element rests on supporting elements distributed over the length of the groove, which are adjustable in directions running transversely to the longitudinal extent of the groove. The supporting elements define the once set radial position of the perforating knife.

18 Claims, 5 Drawing Sheets

(56) References Cited

U.S. PATENT DOCUMENTS 5,282,409 A * 2/1994 Rojas ..... 83/698.31
5,357,836 A * 10/1994 Stromberg et al. ..... 83/698.31
5,740,714 A * 4/1998 Martin ..... 83/698.31
5,890,410 A * 4/1999 Hinojosa ..... 83/698.41
6,244,151 B1 * 6/2001 Machamer et al. ..... 83/698.51

* cited by examiner

APPARATUS FOR THE CROSS-PERFORATION OR CROSS-CUTTING OF CONTINUOUS MATERIAL WEBS

TECHNICAL FIELD

The present invention relates to an apparatus for the cross-perforation or cross-cutting of continuous material webs.

BACKGROUND

An apparatus of this type is known from DE-A-39 26 640 (FIGS. 1-3) and has a cylindrical knife holder in which two diametrically opposing cutting blades are inserted, which cutting blades protrude with their cutting edge over the peripheral surface of the knife holder. For the reception of the cutting blades, the knife holder is provided with radial grooves, which extend in the direction of the longitudinal axis of the knife holder and which are open towards the peripheral surface of the knife holder. Inserted in these grooves are holding bars, into which are screwed adjusting screws, which are supported by their front ends on the bottom of the grooves. Each holding bar has a projection, on which the associated cutting blade is supported by its end lying opposite the cutting edge. For the clamping of the cutting blades, clamping screws screwed into the knife holder are present, which engage on the holding bars on that side thereof which lies opposite the cutting blades.

For the radial adjustment of a newly inserted cutting blade, the adjusting screws, once the clamping screws are loosened, are screwed individually. Following completion of the adjusting operation, the clamping screws are tightened. The setting of the cutting blades is then checked on the basis of sample cuts. If need be, this adjusting operation has to be repeated one or more times until the correct setting is found. It is clear that this adjusting operation is very time-consuming. To enable the holding bars to receive the adjusting screws, which, for reasons of strength, must have a certain minimum diameter, they must be relatively wide. The effect of this is that the grooves, too, must be made correspondingly wide.

SUMMARY

The object of the present invention is now to provide an apparatus for cross-perforation or cross-cutting of the type stated in the introduction, in which a simple adjustment of a newly inserted perforating or cutting knife is possible, in conjunction with a space-saving construction.

This object is achieved according to the invention with an apparatus having the features of the present application.

Owing to the resilient supporting of the stop element, once the clamping device is loosened, the stop element, together with the perforating or cutting knife, is pushed out of the groove in the radial direction. This facilitates the adjustment of the perforating or cutting knife with respect to a counter-pressure cylinder which lies opposite the knife holder and cooperates therewith, since, by rotation of the knife holder, the perforating or cutting knife is brought into contact with the counterpressure cylinder, whereby the perforating or cutting knife is forced back. As soon as the perforating or cutting blade is in the correct position, it is clamped by means of the clamping device.

Preferably, the stop element is supported on a supporting device, which is adjustable in a direction running transversely to the longitudinal extent of the groove. This supporting device serves to store the adjustment position of a perforating or cutting knife, so that, when a knife is changed, the position thereof has no longer to be readjusted. This supporting device further serves to absorb the forces which act on the perforating or cutting blade, and the stop element, in the perforating or cutting operation.

Other preferred refinements of the apparatus according to the invention are defined herein.

BRIEF DESCRIPTION OF THE DRAWINGS

The subject of the invention is explained in greater detail below with reference to the drawings, wherein, purely schematically.

DETAILED DESCRIPTION

Figure 1:
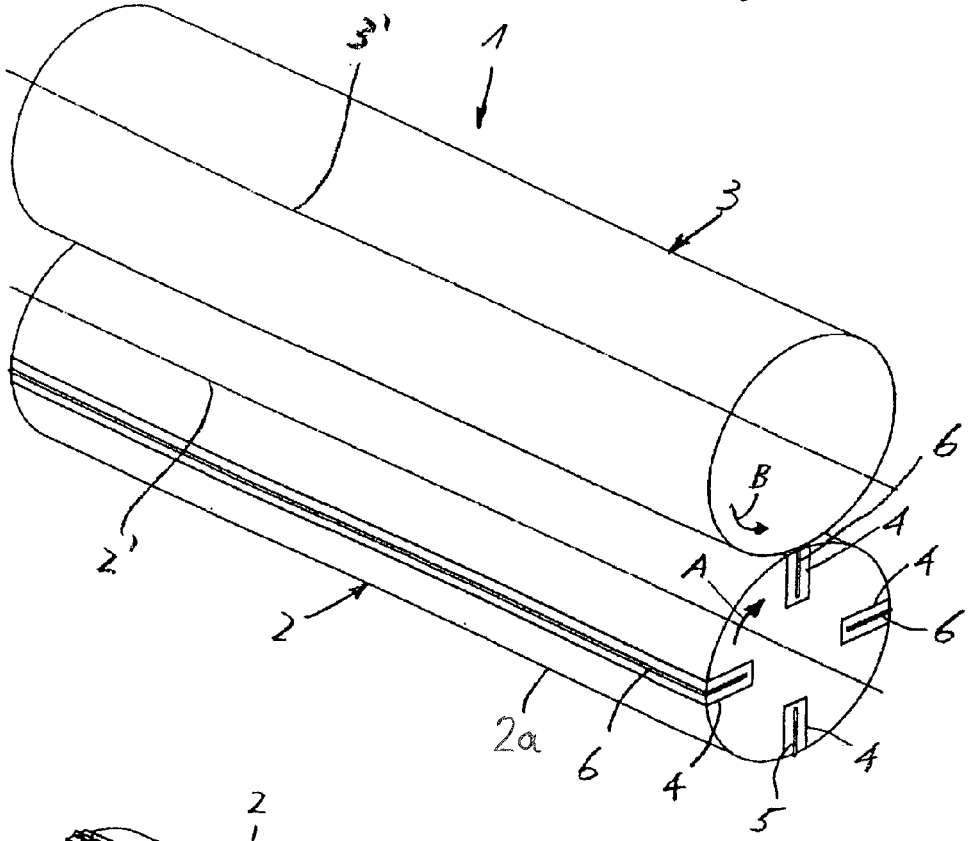
FIG. 1 shows in a perspective view an apparatus for the cross-perforation of continuous material webs.
Figure 2:
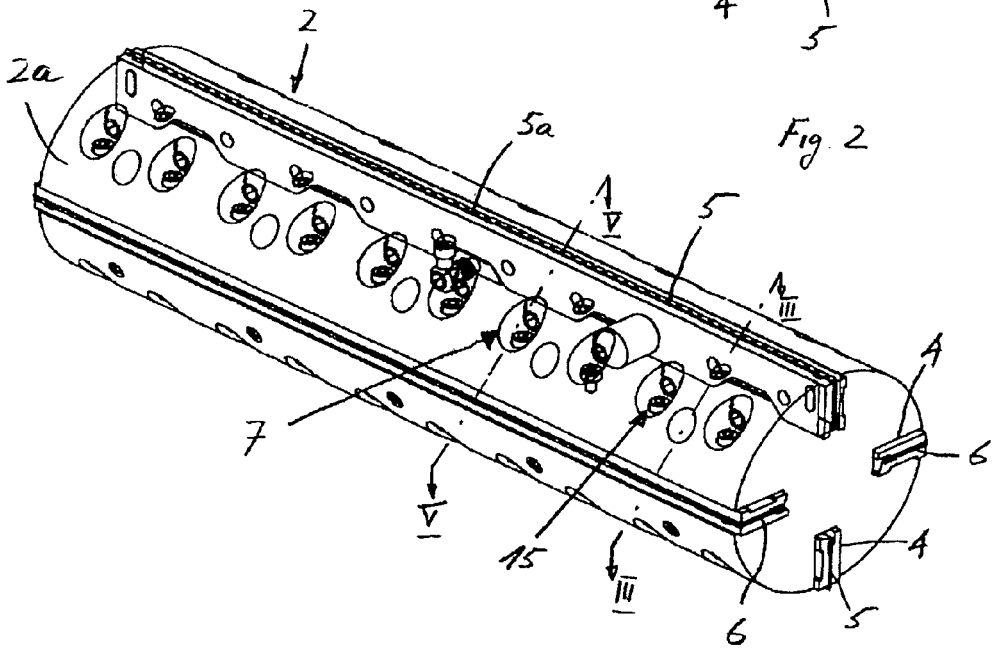
FIG. 2 shows in a perspective view the cylindrical knife holder of the apparatus represented in FIG. 1.

In FIG. 1 an apparatus 1 for the cross-perforation of continuous material webs is shown, which apparatus has a cylindrical knife holder (knife cylinder) 2, which is represented in greater detail in FIG. 2 and which cooperates with a counter-pressure cylinder 3. The knife holder 2 and the counterpressure cylinder 3 are driven about their longitudinal axis 2' and 3' in the direction of the arrows A and B, respectively. The continuously moved material web (not represented) to be perforated runs between the knife holder 2 and the counter-pressure cylinder 3.

The knife holder 2 has four grooves 4 which are open towards its peripheral surface 2*a*, which grooves extend in the direction of the longitudinal axis 2' of the knife holder 2 and lie diametrically opposite one another in pairs. As shown in FIG. 2, two mutually opposing grooves 4 perforating knives 5 are inserted, whilst in the other pair of mutually opposing grooves 4 filling elements 6 are inserted. The design of the mounting for the perforating knives 5 and the filling elements 6 in the grooves 4 is explained below with reference to FIGS. 2 to 9.

Self-evidently, at variance with the shown embodiment of FIG. 2, only one perforating knife 5 and three filling elements 6 as shown in FIG. 1, or else four perforating knives 5, can be inserted into the grooves 4. Under some circumstances, the insertion of filling elements 6 into grooves 4 devoid of a perforating knife 5 can be dispensed with.

As represented schematically in FIG. 2, the perforating knives 5 and the filling elements 6 are held in the grooves 4 by means of a releasable clamping device 7. The structure of this clamping device 7 will be further described with reference to FIGS. 5, 8 and 9.

As shown by FIGS. 3, 5, 6 and 7, the perforating edge 5*a* of the perforating knives 5 protrudes over the peripheral surface 2*a* of the knife holder 2. Each perforating knife 5 is supported at its end lying opposite the perforating edge 5*a* on a stop element 8 disposed in the groove 4, which stop element is provided with a stop member 8*a* on which the perforating knife 5 rests. The perforating knife 5 is clamped between this stop element 8 and a clamping bar 9 inserted in the groove 4. The clamping bar 9 is provided with a travel-limiting arrangement 10 configured as a stop, which travel-limiting arrangement cooperates with the stop member 8*a* and limits a movement of the stop element 8 radially outwards. As shown, in particular, by FIG. 4, a spring arrangement 11 disposed in the groove 4 acts on the stop element 8, which spring arrangement has at least one, preferably a plurality of pressure springs 12 acting on the stop element 8. These pressure springs 12 are supported against the bottom 4*a* of the groove. This spring arrangement 11 or the pressure springs 12, once the clamping device 7 is loosened, force the stop element 8 radially outwards, the travel-limiting arrangement 10, as already mentioned, preventing the stop element 8, once the clamping bar 9 is inserted, from being pushed fully out of the groove 4.

Figure 3:
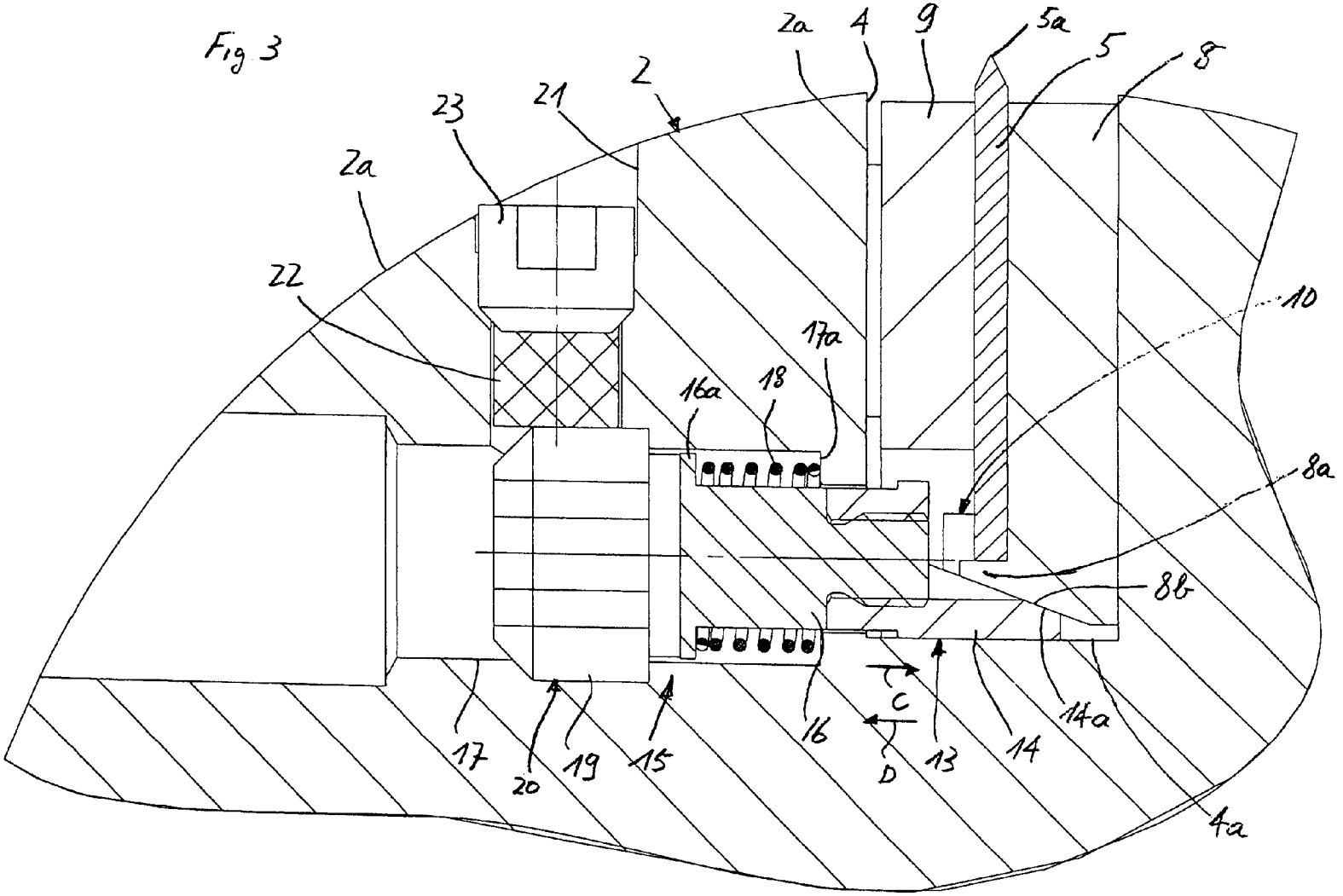
FIG. 3 shows a section along the line III-III in FIG. 2.
Figure 4:
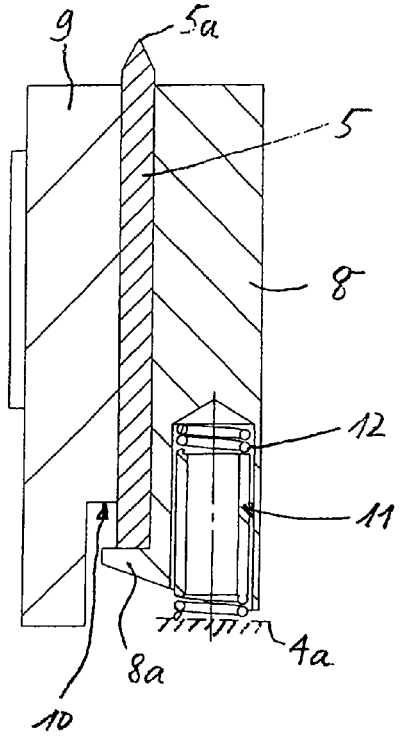
FIG. 4 shows a section through the mounting for a perforating knife.
Figure 6:
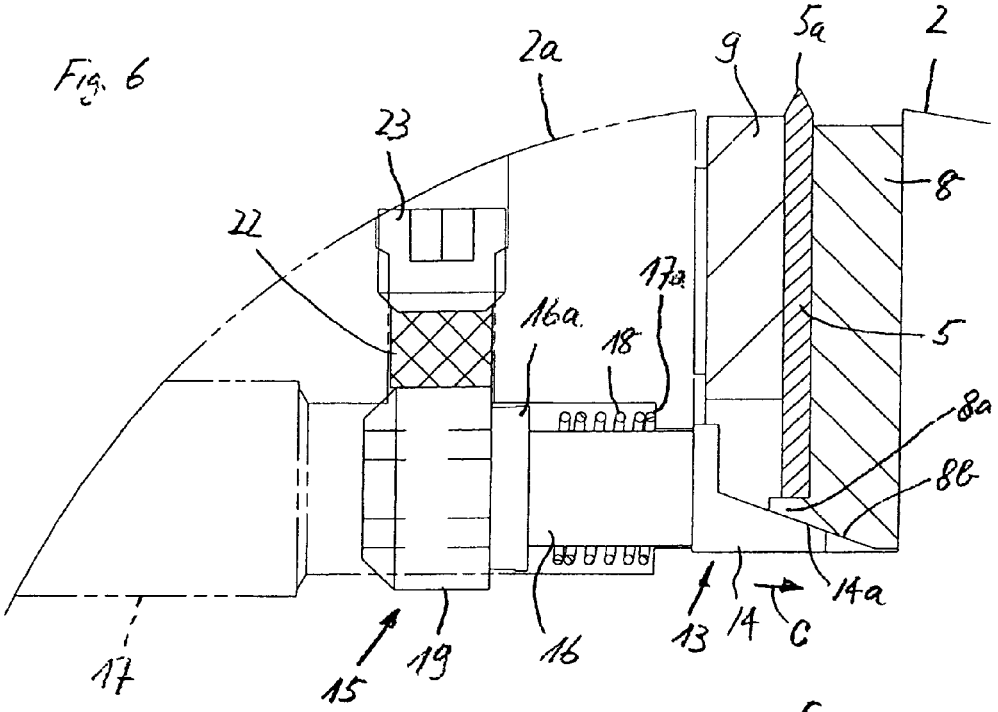
Figure 7:
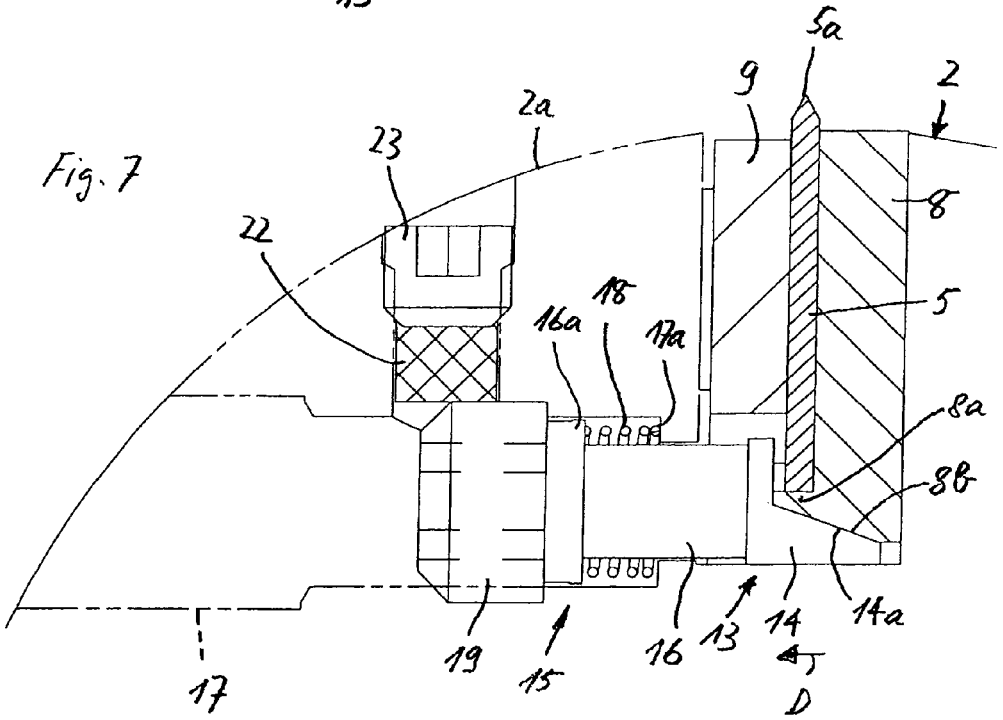

As FIGS. 3, 6 and 7 show, the stop element 8 is supported on a supporting element 14 of a supporting arrangement 13. The latter has a number of such supporting elements 14, which are distributed over the length of the groove 4. Each supporting element 14 is adjustable in directions C, D running transversely to the longitudinal extent of the groove 4. Each supporting element 14 has a support surface 14*a*, which is inclined in the direction of displacement C of the supporting element 14. The stop element 8 rests on this support surface 14*a* with a counterface 8*b*, which is inclined in accordance with the support surface 14*a*. Each supporting element is connected to an adjusting arrangement 15, with which the supporting element 14 can be adjusted in the direction of the arrow C or in the opposite direction in the direction of the arrow D. The adjusting arrangement 15 has a transmission element 16, which is disposed in a transverse bore 17 in the knife holder 2. The transmission element 16 is surrounded by a pressure spring 18, which is supported at one end against a flange 16*a* of the transmission element 16 and at the other end against a shoulder 17*a* of the transverse bore 17. At that end of the transmission element 16 which lies opposite the stop element 14, the transmission element bears against an adjusting member 19, which is mounted rotatably in the knife holder 2 by means of a thread 20 (not represented in detail). In a bore 21 in the knife holder 2, which bore runs transversely to the transverse bore 17, there is disposed a plastics pressure body 22, which bears with an end face against the adjusting member 19 and, at the opposite end face, is in contact with a fixing threaded locating pin 23, which is screwed into the bore 21. By means of the threaded locating pin 23, the adjusting member 19, via the pressure body 22, can be secured in its respective rotational position. The working method of the supporting arrangement 13 and of the adjusting arrangement 15 will be explained later with reference to FIGS. 6 and 7.

Below, the structure of the clamping device 7 is described with reference to FIGS. 5, 8 and 9.

Figure 5:
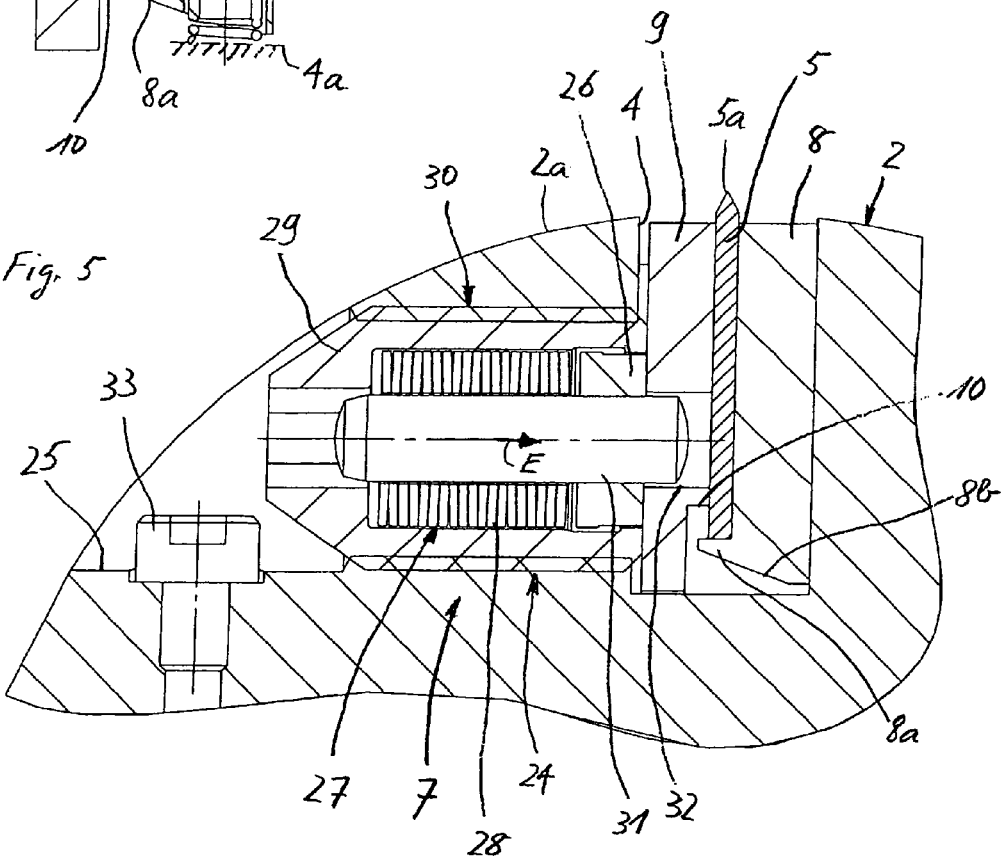
FIG. 5 shows a section along the line V-V in FIG. 2, FIGS. 6 and 7 show, in sectional representations corresponding to FIG. 3, the adjusting arrangement in two different adjustment positions.

The clamping device 7 has a number of clamping elements 24 distributed over the length of the groove 4, which are respectively disposed in a transverse bore 25 in the knife holder 2 (FIG. 5). Each clamping element 24 has a clamping member 26, which is designed to be pushed against the clamping bar 9 by means of a spring arrangement 27. This spring arrangement 27 is formed by a cup spring assembly or a cup spring column 28. The working direction E of the spring arrangement 27 runs transversely to the longitudinal extent of the groove 4. The spring arrangement 27 is supported at one end against the clamping member 26 and bears at the other end against a tensioning element 29, which is mounted rotatably in the knife holder 2 by means of a thread 30 (not represented in detail). A retaining bolt 31 passes through the spring arrangement 27 and engages at one end in an opening 32 in the clamping bar 9. This retaining bolt 31 prevents the clamping bar 9 from falling out once the clamping device 7 is loosened. In the transverse bore 25 there is disposed a travel-limiting screw 33, which is screwed into the knife holder 2. This travel-limiting screw 33 limits the path of movement of the tensioning element 29 and prevents the tensioning element 29 from being unscrewed too far out of the knife holder 2.

Below, the working method of the clamping device 7 and of the clamping elements 24 is explained with reference to FIGS. 8 and 9 respectively.

Figure 8:
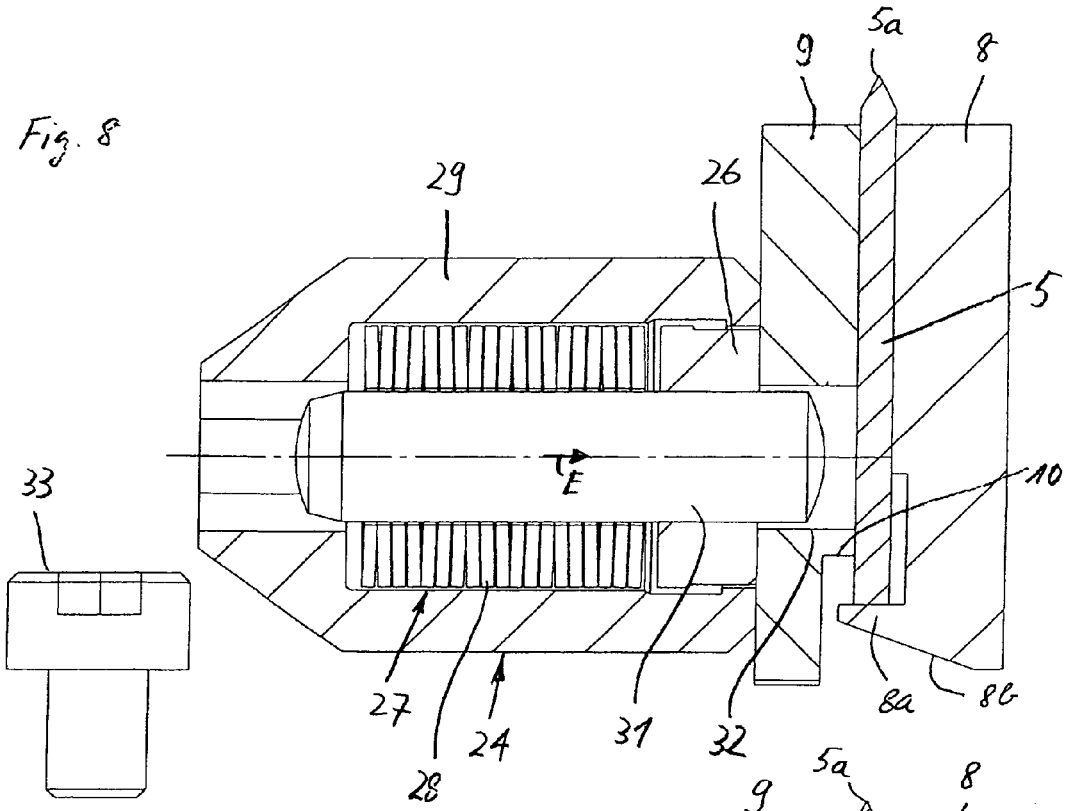
FIGS. 8 and 9 show, in sectional representations corresponding to FIG. 5, the clamping device in the clamping position or in the loosened state.

In FIG. 8, the clamping device 7, that is to say one of its clamping elements 24, is shown in the clamping position in which the tensioning element 29 is screwed far enough into the knife holder 2 that the cup spring assembly or cup spring column 28 is compressed. The generated force acting in the working direction E is transmitted via the clamping member 26 to the clamping bar 9. The perforating knife 5 is thereby clamped between the stop element 8 and the clamping bar 9.

Figure 9:
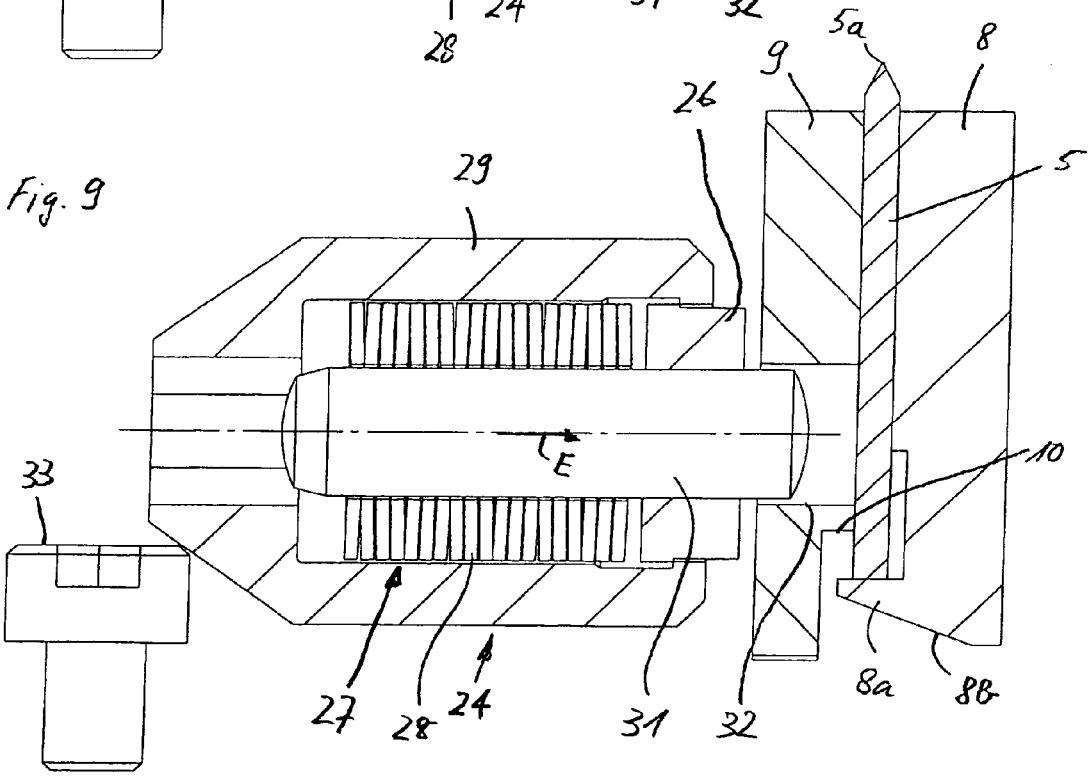

FIG. 9 shows the clamping element in the loosened state. The tensioning element 29 is unscrewed to the point where the cup spring assembly or cup spring column 28 is slackened. In this loosened state, too, the retaining bolt 31 engages in the opening 32 in the clamping bar 9 and prevents the clamping bar 9 from falling out of the groove 4.

The shown and described embodiment of the clamping elements 24 has the advantage that the rotary movement of the tensioning element 29 is not transmitted to the clamping member 26, and nor, therefore, to the clamping bar 9. The relatively high clamping force generated by the cup spring assembly or cup spring column 28 is transmitted by frictional contact to the clamping bar 9.

In FIGS. 6 and 7, the adjusting device 15 is shown in a first, rear end position (FIG. 6) and in a second, front end position (FIG. 7). In both end positions, the stop element 8 rests with its counterface 8*b* on the support surface 14*a* of the supporting element 14. Between the supporting element 14 and the stop element 8, a positive connection exists. A positive connection of this kind also exists between the stop element 8 and the perforating knife 5 resting on the stop member 8*a* of the stop element 8.

In order to obtain this positive connection between the supporting element 14 and the stop element 8, and thus between the perforating knife 5 and the supporting element 14 in respect of each radial adjustment position of the perforating knife 5, the supporting element 14 can be displaced out of the rear adjustment position shown in FIG. 6, in the direction of the arrow C, towards the front adjustment position shown in FIG. 7. All intermediate positions are here continuously adjustable. The supporting element 14 is fixed in the respectively set adjustment position by tightening of the threaded locating pin 23.

The pressure spring 18 ensures that, when the adjusting member 19 is unscrewed, the supporting element 14 is automatically forced back in the direction of the arrow D.

The supporting elements 14 absorb the forces which in the perforating operation act on the perforating knife 5 and the stop element 8.

The supporting elements 14 fixed in a specific adjustment position fix the adjustment position of the perforating knife 5. This means that, when the perforating knife 5 is changed, the new perforating knife can be inserted into the groove 4 without the need for a new adjusting operation. In the event of a knife change, the new perforating knife 5, once the clamping elements 24 are loosened, is inserted between the stop element 8 and the clamping bar 9 and, together with the stop element 8, is forced back to the point where the stop element 8 butts against the supporting elements 14. The clamping elements 14 are then brought into the clamping position shown in FIG. 8.

When a perforating knife 5 is inserted for the first time, its working position must naturally be set. For this, the clamping elements 24 are totally released (see FIG. 9) and the supporting elements 14 are moved into their rear end setting (see FIG. 6). Then a perforating knife 5 is pushed between the clamping bar 9 and the stop element 8, which is pushed radially outwards by means of the pressure springs 12. Through rotation of the knife holder 2, the perforating knife 5 is guided past the counterpressure cylinder 3 and, together with the stop element 8, is hereupon forced back. In the adjustment position which has thus been fixed, the clamping elements 24 are tightened to the point where the perforating knife 5 is secured between the clamping bar 9 and the stop element 8. The supporting elements 14 are now advanced in the direction of the arrow C, until their support surface 14*a* bears against the counterface 8*b* of the stop element 8. The clamping elements 24 are then brought into their clamping setting (see FIG. 8) by rotation of the tensioning elements 29.

If, in place of the perforating knives 5 with perforating edge 5*a*, cutting knives provided with a cutting edge are inserted into the grooves 4, then the apparatus described with reference to FIGS. 1 to 9 can be used for the cross-cutting of continuous material webs.

What is claimed is:

1. An apparatus for the cross-perforation or cross-cutting of continuous material webs, comprising:

a cylindrical knife holder that is rotatable about its longitudinal axis and has at least one groove that is open towards an outer peripheral surface of the knife holder and that extends in a direction of the longitudinal axis of the knife holder and in which a perforating or cutting knife is exchangeably inserted, a perforating or cutting edge of the perforating or cutting knife protruding radially outward of the outer peripheral surface of the knife holder, a releasable clamping device including a clamping bar, the clamping device for clamping, via the clamping bar, the perforating or cutting knife in the groove, wherein the perforating or cutting knife is supported, at an end of the perforating or cutting knife opposite the perforating or cutting edge, on a stop member of an L-shaped stop element, the L-shaped stop element being disposed in the groove, and being adjustable in a radial direction of the knife holder once the clamping device is loosened, and wherein the perforating or cutting knife is disposed between a portion of the L-shaped stop element and the clamping bar, the clamping bar comprising a travel-limiting arrangement which cooperates with the stop member of the L-shaped stop element and limits movement of the L-shaped stop element radially outward, and a spring arrangement disposed in the groove that acts on the L-shaped stop element, wherein a force of the spring arrangement moves the L-shaped stop element outwards in a direction away from a bottom of the groove once the clamping device is loosened.

2. The apparatus as claimed in claim 1, wherein the spring arrangement has at least one pressure spring that acts on the stop element and is supported against the bottom of the groove.

3. The apparatus as claimed in claim 1, wherein a supporting arrangement is provided, on which the stop element is supported and which is adjustable in a direction running transversely to a longitudinal extent of the groove.

4. The apparatus as claimed in claim 3, wherein the supporting arrangement has a number of supporting elements that are distributed over a length of the groove and each of the supporting elements is provided with a support surface, on which the stop element is supported by a corresponding counterface of the stop element.

5. The apparatus as claimed in claim 4, wherein the support surface is inclined in a direction of displacement of the associated supporting element, and the corresponding counterface of the stop element is correspondingly inclined.

6. The apparatus as claimed in claim 4, wherein each supporting element is connected to an adjusting arrangement, with which the supporting element can be adjusted in opposite directions.

7. The apparatus as claimed in claim 6, wherein the adjusting arrangement has an adjusting member, which is mounted rotatably in the knife cylinder.

8. The apparatus as claimed in claim 7, wherein the adjusting member is mounted in the knife cylinder by a thread.

9. The apparatus as claimed in claim 1, wherein the clamping device is formed by a number of clamping elements that are distributed over a length of the groove and each of the clamping elements has a spring arrangement, the working or operating direction of the spring arrangement runs transversely to the longitudinal extent of the groove and which acts on a clamping member.

10. The apparatus as claimed in claim 9, wherein the spring arrangement is a cup spring arrangement.

11. The apparatus as claimed in claim 9, wherein the spring arrangement is supported at one end against a tensioning element that is mounted rotatably in the knife holder by a thread.

12. The apparatus as claimed in claim 1, wherein the clamping bar is inserted in the groove and the clamping device acts upon the clamping bar.

13. The apparatus as claimed in claim 9, wherein each clamping element has a retaining bolt that passes through the spring arrangement and engages in an opening in the clamping bar.

14. The apparatus as claimed in 12, wherein the clamping bar has a travel-limiting arrangement for the stop element, which limits the path of movement of the stop element once the clamping device is loosened.

15. The apparatus as claimed in claim 12, wherein each clamping element has a retaining bolt that passes through the spring arrangement and engages in an opening in the clamping bar.

16. The apparatus as claimed in claim 1, wherein two or more grooves are configured in the knife holder, at least a part of the grooves being equipped with the perforating or cutting knife which can be clamped in the corresponding groove by the clamping device and is supported on the stop element.

17. The apparatus as claimed in claim 16, wherein at least one groove is provided with an inserted exchangeable filling element without a perforating or cutting blade, wherein the filling element extends over a length of the at least one groove and can be clamped in the at least one groove by the releasable clamping device.

18. An apparatus for the cross-perforation or cross-cutting of continuous material webs, comprising:

a cylindrical knife holder that is rotatable about its longitudinal axis and has at least one groove that is open towards an outer peripheral surface of the knife holder and that extends in a direction of the longitudinal axis of the knife holder and in which a perforating or cutting knife is exchangeably inserted, a perforating or cutting edge of the perforating or cutting knife protruding radially outward of the outer peripheral surface of the knife holder, a releasable clamping device for including a clamping bar, the clamping device for clamping, via the clamping bar, the perforating or cutting knife in the groove, wherein the perforating or cutting knife is supported, at an end of the perforating or cutting knife opposite the perforating or cutting edge, on a stop member of an L-shaped stop element, the L-shaped stop element being disposed in the groove, and being adjustable in a radial direction of the knife holder once the clamping device is loosened, and wherein a portion of the L-shaped stop element is disposed on an opposite side of the perforating or cutting knife from the clamping device, and the clamping bar comprises a travel-limiting arrangement which cooperates with the stop member of the L-shaped stop element and limits movement of the L-shaped stop element radially outward, a spring arrangement disposed in the groove that acts on the L-shaped stop element, wherein a force of the spring arrangement moves the L-shaped stop element outwards in a direction away from a bottom of the groove once the clamping device is loosened.

* * * * *